US005419142A

United States Patent [19]

Good

[11] Patent Number: 5,419,142

[45] Date of Patent: May 30, 1995

[54] THERMAL PROTECTION FOR SUPERCONDUCTING MAGNETS

[76] Inventor: Jeremy A. Good, 72 Lexham Gardens, London W8 5JB, England

[21] Appl. No.: 179,514

[22] Filed: Jan. 10, 1994

[30] Foreign Application Priority Data

Jan. 8, 1993 [GB] United Kingdom ..... 9300312

[51] Int. Cl.[6] ..... F25B 19/00

[52] U.S. Cl. ..... 62/51.1; 62/259.2; 62/77; 505/890; 505/897

[58] Field of Search ..... 62/51.1, 77, 260, 259.1, 62/259.2; 505/890, 897, 898

[56] References Cited

U.S. PATENT DOCUMENTS

| | | | |
|---|---|---|---|
| 3,049,620 | 8/1962 | George et al. | 62/260 X |
| 3,695,057 | 10/1972 | Moisson-Fanckhauser | 505/898 X |
| 4,872,314 | 10/1989 | Asano et al. | 62/51.1 X |
| 4,982,571 | 1/1991 | Marsckik et al. . | |

*Primary Examiner*—Christopher Kilner
*Attorney, Agent, or Firm*—Wood, Herron & Evans

[57] ABSTRACT

Apparatus for maintaining a superconducting magnet which is refrigerated within a cryostat at or near its operating temperature in the event of the cryostatic refrigerator ceasing to operate comprising a heat sink within the cryostat and in thermal communication with the magnet and means automatically to transfer heat from the heat sink out of the cryostat.

7 Claims, 1 Drawing Sheet

THERMAL PROTECTION FOR SUPERCONDUCTING MAGNETS

Figure 1:
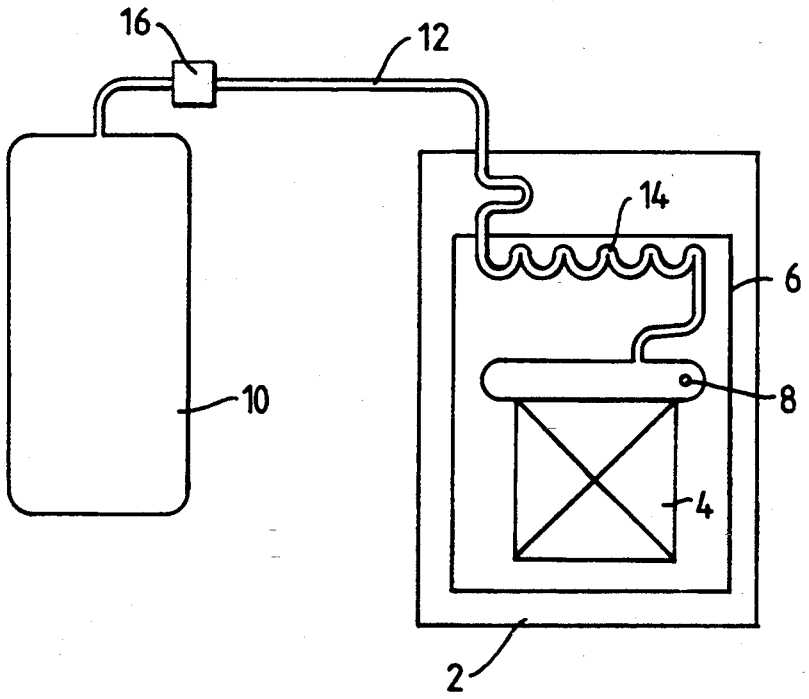

This invention relates to the provision of thermal protection for superconducting magnets, particularly superconducting magnets operating at temperatures above 4.2K, by providing means to maintain the magnet at or near its operating temperature in the event of a power failure interrupting the cryogenic cooling system.

Normally a superconducting magnet is operated in a bath of liquid helium at a temperature of 4.2K or below. The specific heat of the liquid is high (approx. 20 joules/gm for the latent heat) compared to the very low specific heat for most metals and plastics at 4K (typically $10^{-4}$ joules/gm). The liquid helium provides a thermal reservoir absorbing heat from the outside environment and keeps the magnet at its correct operating temperature.

Magnets are often operated using a refrigerator which provides cooling power either as liquid helium or as a liquid gas mixture circulating in cooling pipes around the magnet. Such systems normally operate at 4.2K or less, but are expensive to build and maintain. A magnet operating at approx 8K requires a much less expensive and complicated 2 stage refrigerator as opposed to the 3 stages normally required for 4K operation.

Superconducting magnets contain large amounts of stored energy. A modest sized magnet might have an inductance of 50 Henry and an operating current of 200 Amps with a stored energy of 2 megajoules. If the magnet warms above its correct operating temperature it will lose its superconducting properties and electrical resistance appears in the winding causing the magnetic field to quench and dissipate its energy in the winding. The resulting surge of heat energy can be damaging to the magnet and designers of superconducting magnets have to consider how to dissipate the energy safely. If the energy is dissipated in the windings the magnet warms up significantly. It must then be recooled before it can be re-energised. For a magnet that is bath cooled by liquid helium, this means the addition of more liquid helium. For a refrigerated magnet cooling power must be applied for a significant period of time. A powerful fridge will cool the magnet more quickly, but since for 99% of its operating life the fridge only maintains the superconducting magnet at its operating temperature, which requires little cooling power, it is preferred to use a low power fridge.

For instance, to cool the magnet described above, a cooling power of just 4 watts might be sufficient in continuous operation. To remove 2 megajoules of electrical energy dissipated as heat with 4 watts of cooling power would require 500,000 secs, a significant period. In practice the size of refrigerator is chosen to be as small as possible comparable with a reasonable time to cool the magnet from ambient to its operating temperature and to provide a safe working margin at the operating temperature.

In the event of a mains power failure the refrigerator will cease operation unless equipped with emergency back up power a further significant inconvenience. The magnet will warm due to heat leaks into it from the warmer exterior environment.

It is important that it stays cold long enough to allow a battery operated circuit to detect the refrigerator failure and take action to discharge the magnet by reducing the current in the magnet in a controlled fashion. This avoids a magnet quench and allows the magnet to be re-energised immediately power is restored. This discharge takes some significant period of time. For the 50 Henry magnet described above a reverse voltage of 10 volts will provide a current discharge of a fifth of an amp per sec, i.e. 1000 secs to set the 200 amp operating current to zero. If the magnet is discharged faster by using a higher voltage there may be significant eddy current heating as well as safety considerations. It is important therefore to ensure that the magnet can be kept cool long enough to allow a safe discharge of its energy. In normal practice a period of 514 15 secs waiting time is allowed to distinguish and ignore short term faults or power flicker and this is followed by the discharge time.

Apparatus in accordance with the invention, for maintaining a superconducting magnet, which is refrigerated within a cryostat, at or near its operating temperature in the event of the refrigerator ceasing to operate, comprises a heat sink within the cryostat and in thermal communication with the magnet and means automatically to transfer heat from the heat sink out of the cryostat.

One embodiment of such an apparatus comprises a closed vessel/container within the cryostat in thermal communication with the magnet and connected by a tube to a larger closed vessel/container outside the cryostat, the vessels being filled with a gas under high pressure at room temperature.

Such an arrangement provides a heat sink within the cryostat which serves to hold the magnet close to its operating temperature in the absence of refrigeration by absorbing heat from the magnet and, as the density of the gas in the smaller vessel increases, transferring that heat into the larger vessel as gas flows from the smaller to the larger vessel. This is particularly relevant for temperatures from 6–12K where NbSn and similar intermetallic superconductors can be used to generate strong magnetic field for industrial and medical applications such as NMR Imaging without the use of liquid helium, as described in our British Patent application No. 9208437.5, for example.

The two vessels are connected by a thin tube, which may contain a heat exchanger, and may be filled with high pressure (150–200 atmospheres) helium gas. One cylinder, the larger is at room temperature exterior to the cryostat. The other vessel is smaller, and may be one tenth the volume of the larger, and is thermally anchored to the magnet. A thin tube connects them and there may be a heat exchanger through which the gas must pass on its way from one cylinder to the other. The heat exchanger is attached to the intermediate radiation temperature shield which is part of the cryostat. The shield reduces heat loads from the room temperature parts of the cryostat to the magnet.

The invention will now be described by way of example only and with reference to the accompanying drawing, in which:

FIG. 1 is a schematic diagram of an apparatus in accordance with the invention.

Referring to FIG. 1, a superconducting magnet 4 is contained within a cryostat 2 and is maintained at an operating temperature of between 4.2K and 8K by suitable cryogenic cooling means (not shown). Within the cryostat 2 is a radiation shield 6. A small gas vessel 8 containing helium is thermally anchored to the magnet 8 and is connected to a large gas vessel 10, which is about 10 times the size of the small vessel 8, outside the cryostat 2 by a small bore tube 12. A heat exchanger 14 is provided in the tube 12 within the radiation shield 6. A flow regulator, or valve system, 16 is provided in the tube 12 to restrict the flow of helium gas from the large vessel 10 to the small vessel 8 but to permit the gas to flow freely in the opposite direction.

When the cryostat 2 is warm, 90% of the gas is in the larger vessel 10 at a pressure of, for example, 200 bar. As the cryostat 2 is cooled the gas density in the cold vessel 8 increases and gas transfers from the large vessel 10 at room temperature to the smaller, cold vessel 8. At 6K, a reasonable operating temperature for the superconducting magnet 4, the gas density is 50 times that at room temperature and about 80% of the gas is in the cold vessel 8 at a pressure of approx 40 bar.

As the system cools the refrigerator has to provide cooling power to cool the incoming gas. The cool down time may be improved by providing a valve system 16 which allows a low rate of helium to exhaust from the large vessel 10 to the cold vessel 8 but an easy return of helium from the cold vessel 8 to the large vessel 10 when the system is warming up.

Since there is spare cooling capacity in the refrigerator the gas can enter the cold vessel 8 over a period of time while the system is cold and being brought into operation.

The volume of a small vessel 8 is 5 liters and the large vessel 10 about 50 liters, and at 6K and 40 bar pressure the small vessel 8 will contain over 2500 gms of helium gas. In the event of failure of the refrigerator, half the gas is expelled from the small vessel 8 taking up heat as it does so for a temperature rise to 12K.

At 6K the specific heat of 2500 gms of pressurised helium is about 7500 J/K compared to the specific heat of a magnet weighing 200 kilo which will have a specific heat at 6K of about 150–200 J/K. Apparatus in accordance with the invention can thus play an important role in keeping the magnet 4 cold.

The small vessel 8 consists of a long tube, 15 mm in diameter and 35 meters long (or 25 mm diameter and 11 meters long), which could be relatively thin walled and manufactured from stainless steel tube which is light and low cost. It is also easy to form into a suitable shape to attach to the magnet and because of its large surface area, easy to provide a good thermal ground to the magnet.

I claim:

1. Apparatus for maintaining a superconducting magnet which is refrigerated within a cryostatic refrigerator at or near its operating temperature in the event of said cryostatic refrigerator ceasing to operate, said apparatus comprising a heat sink within said cryostatic refrigerator and in thermal communication with said magnet, and means automatically to transfer heat from said heat sink out of said cryostatic refrigerator.

2. Apparatus as claimed in claim 1, said heat sink comprising a closed vessel within said cryostatic refrigerator which is connected by conduit means to a larger closed vessel outside said cryostatic refrigerator, both said vessels being filled with a gas under high pressure at room temperature.

3. Apparatus as claimed in claim 2, said vessel within said cryostatic refrigerator comprising a thin walled tube configured so as to conform closely to the surface of said magnet.

4. Apparatus as claimed in claim 2, the volume of said vessel outside said cryostatic refrigerator being at least ten times the volume of said vessel within said cryostatic refrigerator.

5. Apparatus as claimed in claim 2, said cryostatic refrigerator comprising an intermediate radiation temperature shield, and said conduit means comprising a heat exchanger which is in thermal communication with said temperature shield.

6. Apparatus as claimed in claim 2, said gas being helium.

7. Apparatus as claimed in claim 6, the pressure of said helium, when said cryostatic refrigerator is at room temperature, being 200 Bar.

* * * * *

UNITED STATES PATENT AND TRADEMARK OFFICE

CERTIFICATE OF CORRECTION

PATENT NO. : 5,419,142

DATED : May 30, 1995

INVENTOR(S) : Dr. Jeremy Andrew Good

It is certified that error appears in the above-identified patent and that said Letters Patent is hereby corrected as shown below:

At Column 2, line 14 please delete "514 15 secs" and insert -- 5-15 secs --.

Signed and Sealed this

Twelfth Day of September, 1995

*Attest:*

Bruce Lehman

BRUCE LEHMAN

*Attesting Officer*

*Commissioner of Patents and Trademarks*